US007549518B2

(12) United States Patent
Pennington

(10) Patent No.: US 7,549,518 B2
(45) Date of Patent: Jun. 23, 2009

(54) BRAKE

(76) Inventor: Lance Pennington, 24 Center St., Pine Bush, NY (US) 12566

( * ) Notice: Subject to any disclaimer, the term of this patent is extended or adjusted under 35 U.S.C. 154(b) by 0 days.

(21) Appl. No.: 11/724,917

(22) Filed: Mar. 16, 2007

(65) Prior Publication Data

US 2009/0095577 A1 Apr. 16, 2009

(51) Int. Cl.
*B60T 1/00* (2006.01)

(52) U.S. Cl. ..... 188/31; 188/40; 188/60; 312/201

(58) Field of Classification Search ..... 188/31, 188/32, 40, 60; 312/198, 201, 202; 410/66, 410/94

See application file for complete search history.

(56) References Cited

U.S. PATENT DOCUMENTS 3,298,475 A * 1/1967 Mersereau et al. ..... 188/200
3,511,347 A * 5/1970 Pritchard ..... 188/216
4,256,355 A * 3/1981 Yamaguchi et al. ..... 312/201
4,607,896 A * 8/1986 Peterman ..... 312/201
5,160,189 A * 11/1992 Johnston et al. ..... 312/201
5,401,090 A * 3/1995 Muth et al. ..... 312/201
6,099,220 A * 8/2000 Poth ..... 410/94
6,595,332 B1 * 7/2003 Pennington ..... 118/31
2007/0252491 A1 * 11/2007 Rainville ..... 312/201

* cited by examiner

*Primary Examiner*—Christopher P Schwartz

(57) ABSTRACT

A brake for retaining a mobile carriage on which apparatus such as storage facilities are located. The brake includes a pivot member with a release end and a locking end and with a claw at the locking end. The claw engages a slotted member when the locking end is depressed. The opposite end of the pivot member from the locking end is the release end. Adjacent the release end is a slot which rides on a stoop pin to prevent the release end from being depressed below the horizontal.

7 Claims, 4 Drawing Sheets

BRAKE

BACKGROUND OF THE INVENTION

1. Field of the Invention

This invention relates to a brake and, more particularly, to a brake to retain a mobile carriage, such as used with a storage facility, in a fixed location.

2. Prior Art

The need to conserve space along with the increasing need for storage facilities has resulted in the widespread use of mobile storage facilities. Such mobile storage facilities are built to roll on a track. To avoid injury to persons using the storage facilities, it is essential that such storage facilities be positively secured in place.

In an earlier patent, U.S. Pat. No. 6,595,332, a brake for retaining mobile storage facilities is disclosed. That brake provides the desired retention as well as ready release for mobile storage facilities. However, that brake is comparatively complicated and, therefore has a more significant cost and includes a spring which ultimately will weaken and require replacement.

OBJECTS

It is an object of the invention to provide a brake for mobile storage facilities that positively secures the storage facilities while providing increased durability and reduced cost.

It is a further object of the present invention to provide a brake that is simple in construction and easy to use.

It is still a further object of the present invention to provide a brake that is maintenance free.

SUMMARY OF THE INVENTION

A brake is provided for use on a mobile carriage. The mobile carriage is mounted on a platform with a track on which the mobile carriage rolls. A pivot member has a locking end and a release end. The pivot member is mounted to pivot generally midway between the locking end and the release end. A claw is mounted on the pivot member at the locking end. Means are provided adjacent the release end of the pivot member and means are secured to the means for mounting the pivot member for limiting the release end of the pivot member from being depressed below the horizontal.

| NUMERAL | BRIEF DESCRIPTION |
|---|---|
| 11 | Base or Corner |
| 13 | Movable Carriage |
| 15 | Storage Facilities |
| 17 | Wheels |
| 19 | Platform |
| 21 | Tracks |
| 23 | Channel |

-continued

| NUMERAL | BRIEF DESCRIPTION |
|---|---|
| 25 | Slotted Member |
| 27 | Back Plate |
| 29 | Bolts |
| 31 | Pivot Member |
| 32 | Brake Pad |
| 33 | Top Edge |
| 35 | Bottom Edge |
| 37 | Top Section |
| 39 | Center Bolt |
| 41 | Locking End |
| 43 | Release End |
| 45 | Claw |
| 47 | Teeth |
| 49 | Vertical Opening |
| 51 | Stop Bolt |

DETAILED DESCRIPTION OF THE PREFERRED EMBODIMENT

Figure 1:
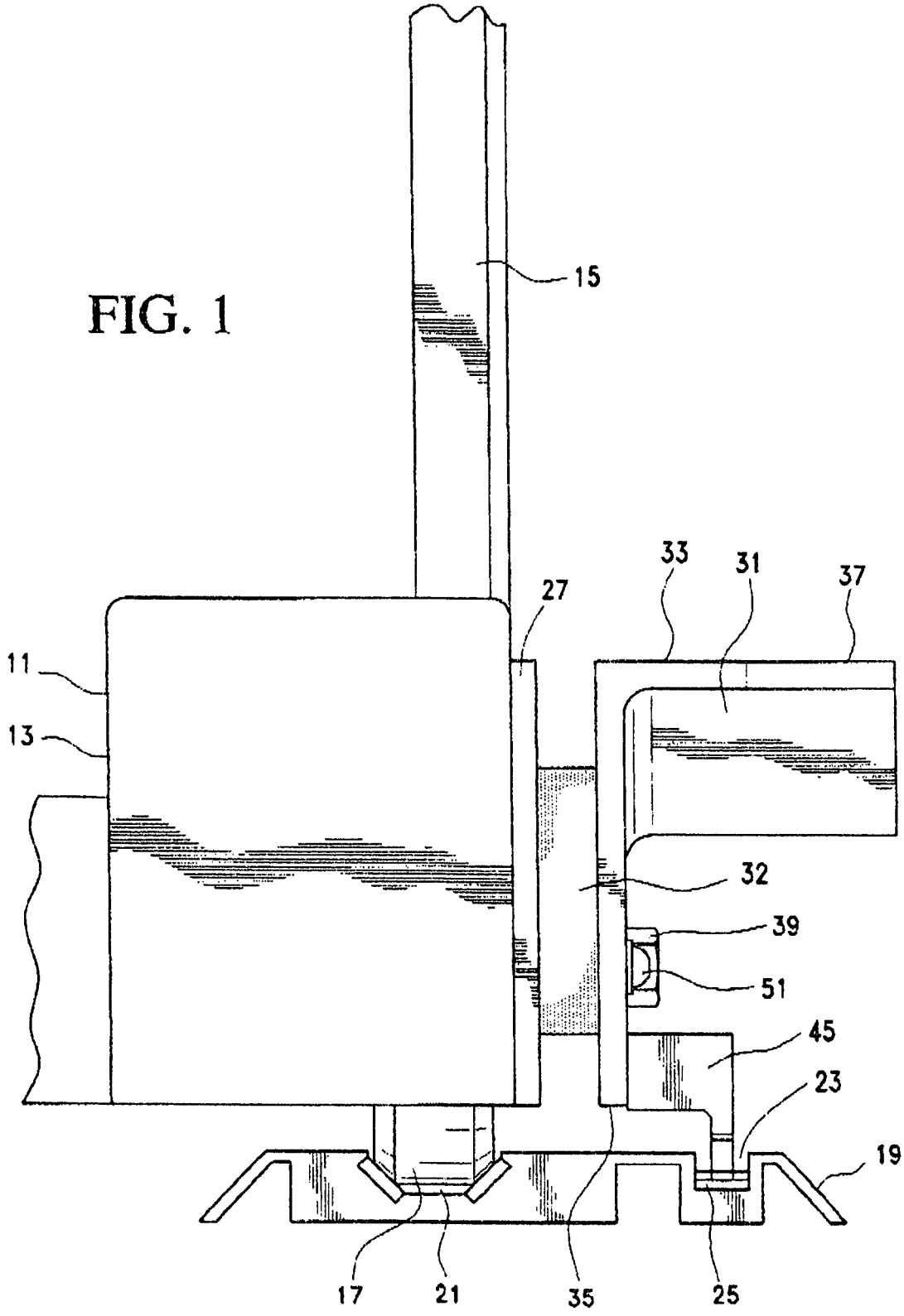
FIG. 1 is a side elevation of the carriage which is movable.
Figure 2:
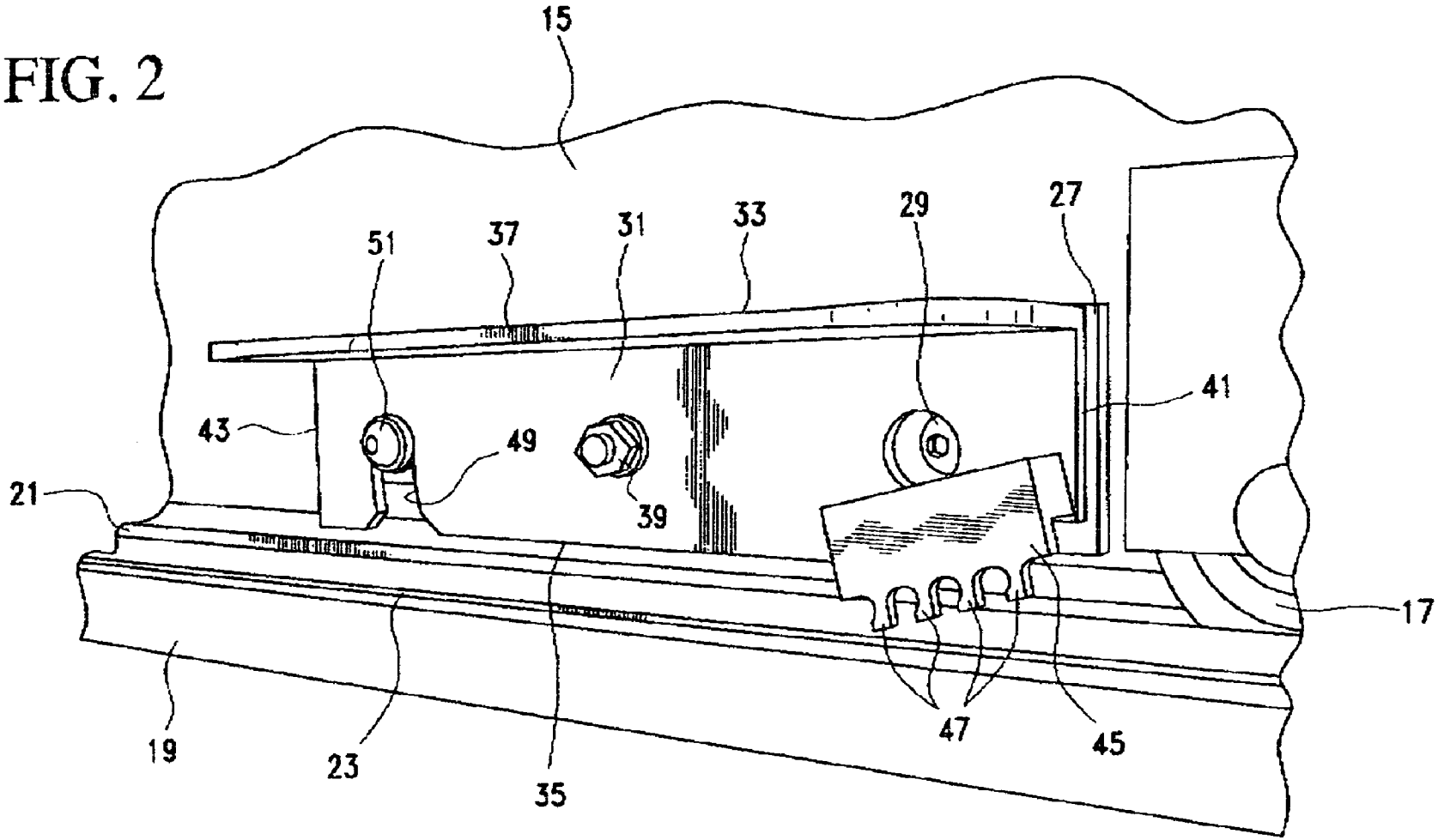
FIG. 2 is a pictorial view of the movable carriage showing the pivot member with the claw affixed to it and with the claw withdrawn from the channel.
Figure 3:
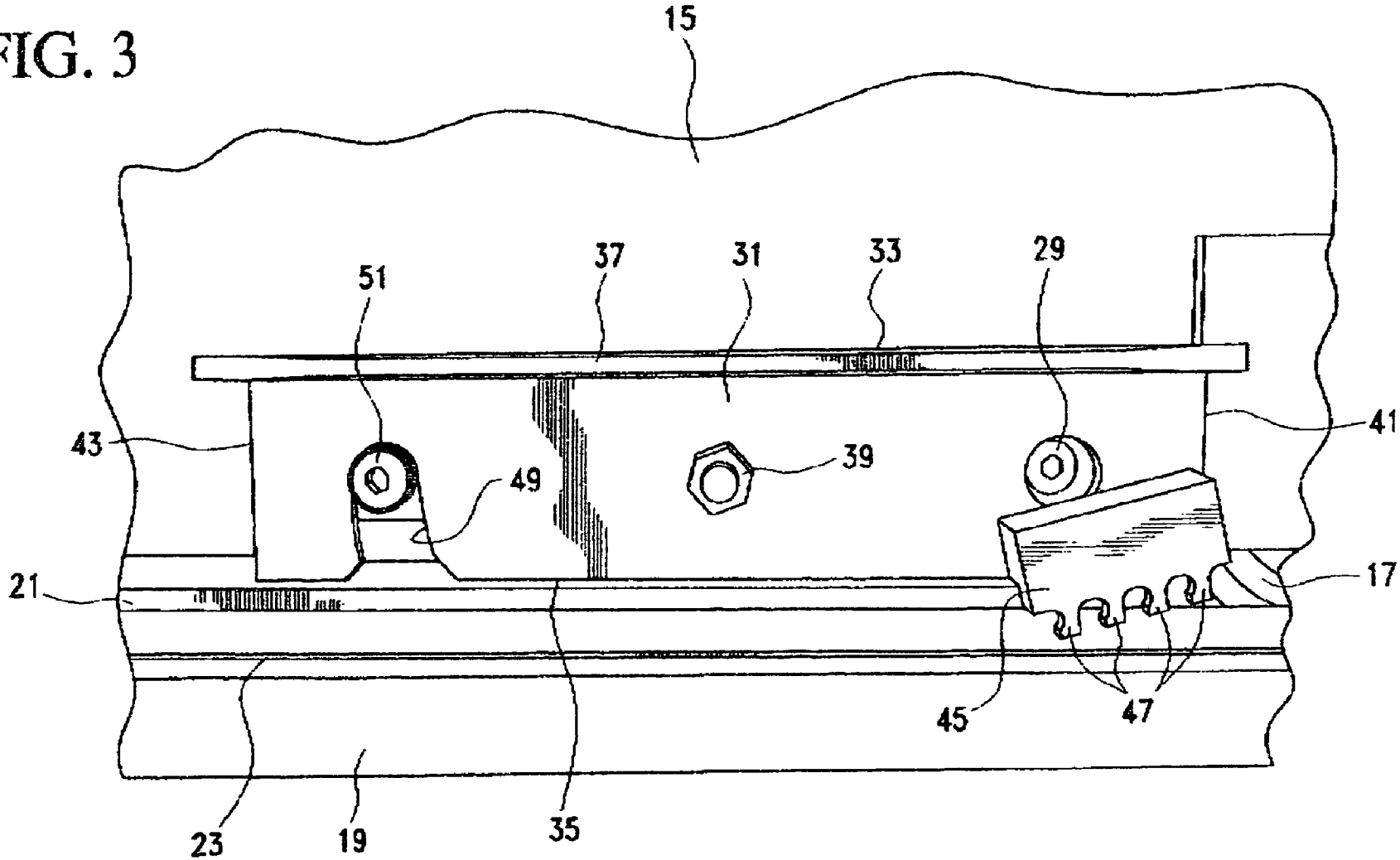
FIG. 3 is a front elevation of the pivot member in a horizontal position and with the claw withdrawn.
Figure 4:
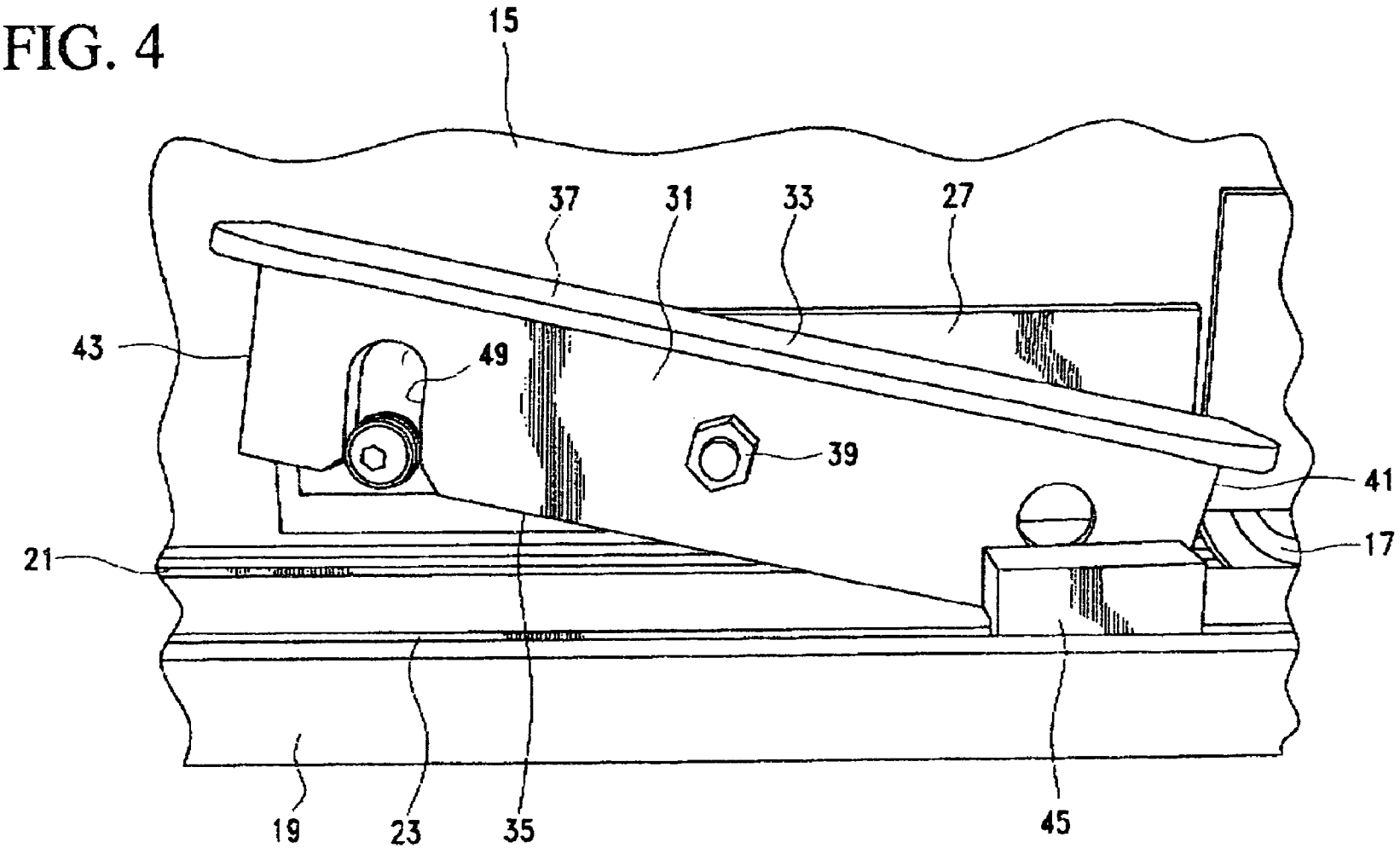
FIG. 4 is a front elevation of the pivot member depressed with the claw in the channel to engage the slotted member.

Referring now to FIG. 1 the base or corner 11 of a carriage 13 which is movable is shown in which a storage facility 15 is mounted so as to be mobile. The carriage 13, which includes wheels 17, is mounted on a platform 19. The platform 19 includes tracks 21 on which the wheels 17 of the carriage 13 roll with the storage facility mounted on it. The brake may, however, be used with a wide variety of movable apparatus of which storage facilities 15 are but one.

A channel 23 which is parallel to the tracks 21 is located in a spaced relationship to the tracks 21. A slotted member 25 is secured within the channel 23. A chain may be used as the slotted member 25 but other forms of slotted members 25 may also exist. The brake includes a back plate 27 which is secured to the storage facility 15 by means of bolts 29. Mounted on the back plate 27 is a pivot member 31. Between the back plate and the pivot member 31 there is a brake pad 32. The brake pad 32 (FIG. 1) adds a desired degree of resistance to the rotation of the pivot member 31. As a result, the [pivot member 31 is held in a horizontal position when not being pressed downwardly.

The back plate 27 and the pivot member 31 are preferably both rectangular plates of substantially the same size and are mounted with their larger edges in a generally horizontal position. The pivot member 31 has both a top edge 33 and a bottom edge 35 but the top edge 33 includes a top section 37 which extends at substantially right angles away from the storage facilities 15 from the pivot member 31 for a short distance. The top section 37 serves as a foot rest for actuating the pivot member 31 to secure and to release the brake to and from the platform 19.

A center bolt 39 is secured to the back plate 27 while extending outwardly from the back plate 27 so that the pivot member 31 can rotate on the center bolt 39. The pivot member 31 has two ends, namely a locking end 41 and a release end 43. Affixed to the locking end 41 is a claw 45 which includes a series of teeth 47. The claw 45 is a rectangular plate with the teeth 47 along its base. The claw 45 is affixed to the pivot member 31 at a slight acute angle which slopes downwardly toward the center of the pivot member 31. As a result of this acute angle, when the locking end 41 of the pivot member 31 is depressed, the claw 45 is horizontal so as properly to engage the slotted member 25.

The claw 45 has teeth 47 and the configuration of claw 45 assures a secure engagement of the claw 45 with the slotted member 25. The configuration of the claw 45 must be compatible with the design of the slotted member 25.

At the release end 43 of the pivot member 31 is a vertical opening 49. A stop bolt 51 extends outwardly from the back plate 37. The vertical opening 49 extends from the bottom edge 35 of the pivot member 31 slightly more than halfway up to the top edge 33 of the pivot member 31. The vertical opening 49 slides on the stop bolt 51 and when the release end 43 is forced downwardly so that the pivot member 31 is essentially horizontal, the stop bolt 51 prevents further downward movement of the release end 43.

The operation of the brake is simple. By stepping on the locking end 41 of the pivot member 31, the claw 45 is forced into the slotted member 25 thereby securing the storage facility 15 in a fixed location. By stepping on the release end 43 of the pivot member 31, the pivot member 31 is returned to the horizontal position with the claw 45 removed from the slotted member 25 thereby permitting movement of the storage facility 15.

It is to be understood that the drawings and description are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A brake for use on a mobile carriage, the mobile carriage being mounted on a platform with a track in which the mobile carriage rolls and with a channel in which a slotted member is secured, the brake comprising:

a back plate for mounting on a mobile carriage;

a pivot member having a locking end and a release end and a top section and a bottom section, the top section extends substantially at right angles to the bottom section;

A bolt secured to the back plate, the pivot member being mounted generally midway between the locking end and the release end to pivot on the bolt;

A claw mounted on the pivot member at the locking end, the claw being horizontal when the brake and the pivot member is depressed;

An opening adjacent the release end, the opening extending from the bottom of the pivot member; and A stop bolt secured to the back plate, the stop bolt being located in the opening, the stop bolt limiting the release end of the pivot member from being depressed below the horizontal.

2. A brake according to claim 1 wherein the pivot member has a rectangular shape.

3. A brake according to claim 1 wherein the claw is mounted at an acute angle to the pivot member.

4. A brake according to claim 1 wherein the claw is mounted at an acute angle to the pivot member, the claw being a rectangular member having a base with teeth along the base.

5. A brake according to claim 1 wherein the opening extends slightly more then half way to the top of the pivot member.

6. A brake for use on a mobile carriage, the mobile carriage being mounted on a platform with a track in which the mobile carriage rolls and with a channel in which a slotted member is secured, the brake comprising;

A back plate for mounting on a mobile carriage;

A pivot member having a locking end and a release end, the pivot member having a rectangular shape with a top and a bottom;

means including a bolt for mounting the pivot member generally midway between the locking end and the release end to pivot on the means for mounting the pivot blot;

A claw mounted on the pivot member at the breaking end, the claw being mounted at an acute angle to the pivot member and generally horizontal when the pivot member is member is depressed;

An opening adjacent the release end, the opening extending from the bottom of the pivot member slightly more then half way to the top of the pivot member;

And a stop means including a stop bolt secured to the Back plate, the top means being located in the opening, The stop means limited the release end of the pivot member from being depressed below the horizontal.

7. A brake for use on a mobile carriage, the mobile carriage being mounted on a platform with a track in which the mobile carriage rolls and with a channel in which a slotted member is secured, the brake comprising;

A pivot member having a locking end and a release end, the pivot member having both a top section and a bottom section, the top section extending substantially at right angles to the bottom section; means including a bolt and a back plate for mounting the pivot member, being mounted generally midway between the locking end and the release end to pivot on the pivot bolt;

A claw mounted on the pivot member at the locking end;

Means including an opening adjacent the release end of the pivot member and means secured to the means for mounting the pivot member for limiting the release end of the pivot member from being depressed below the horizontal.

* * * * *